US011021932B2

(12) United States Patent
Rosenthal

(10) Patent No.: US 11,021,932 B2
(45) Date of Patent: Jun. 1, 2021

(54) AUTO-BLEEDING SETTING TOOL AND METHOD

(71) Applicant: GEODYNAMICS, INC., Millsap, TX (US)

(72) Inventor: Wayne O. Rosenthal, Weatherford, TX (US)

(73) Assignee: GEODYNAMICS, INC., Millsap, TX (US)

( * ) Notice: Subject to any disclaimer, the term of this patent is extended or adjusted under 35 U.S.C. 154(b) by 217 days.

(21) Appl. No.: 16/269,966

(22) Filed: Feb. 7, 2019

(65) Prior Publication Data

US 2020/0256156 A1 Aug. 13, 2020

(51) Int. Cl.

| | |
|---|---|
| ***E21B 34/10*** | (2006.01) |
| ***E21B 23/04*** | (2006.01) |
| ***E21B 34/06*** | (2006.01) |

(52) U.S. Cl.

CPC ..... *E21B 34/10* (2013.01); *E21B 23/04* (2013.01); *E21B 34/063* (2013.01); *E21B 2200/06* (2020.05)

(58) Field of Classification Search

CPC ..... E21B 34/10; E21B 23/04; E21B 34/063; E21B 2200/06; E21B 2034/007; E21B 23/065

See application file for complete search history.

(56) References Cited

U.S. PATENT DOCUMENTS

| | | | | |
|---|---|---|---|---|
| 2,799,343 | A | 7/1957 | Conrad | |
| 2,815,816 | A | 12/1957 | Baker | |
| 5,845,669 | A | 12/1998 | Ross | |
| 6,148,916 | A * | 11/2000 | Sampson | E21B 23/00 166/297 |
| 2015/0308208 | A1 * | 10/2015 | Capps | E21B 33/16 166/285 |
| 2016/0186513 | A1 | 6/2016 | Robertson et al. | |
| 2017/0306714 | A1 * | 10/2017 | Haugland | E21B 27/02 |
| 2018/0087330 | A1 | 3/2018 | Bradley et al. | |

OTHER PUBLICATIONS

Extended European Search Report for related European Application No. 20153660.4 dated Sep. 25, 2020.

* cited by examiner

*Primary Examiner* — Yong-Suk (Philip) Ro
(74) *Attorney, Agent, or Firm* — Patent Portfolio Builders PLLC

(57) ABSTRACT

A setting tool for setting an auxiliary tool in a well includes a housing holding a floating piston assembly, the floating piston assembly having a first end and a second end, which is opposite to the first end, an isolation valve assembly in fluid communication with an interior of the housing, where the isolation valve assembly is facing the second end of the floating piston assembly, and a frangible disc located at the first end of the floating piston assembly, to prevent a high-pressure gas to pass through a bore of the floating piston assembly. The floating piston assembly separates the frangible disc from the isolation valve assembly.

32 Claims, 12 Drawing Sheets

AUTO-BLEEDING SETTING TOOL AND METHOD

BACKGROUND

Technical Field

Embodiments of the subject matter disclosed herein generally relate to downhole tools for well operations, and more specifically, to an auto-bleeding setting tool used in a well for actuating an auxiliary tool.

Discussion of the Background

During well exploration, various tools are lowered into the well and placed at desired positions for plugging, perforating, or drilling the well. These tools are placed inside the well with the help of a conduit, e.g., a wireline, electric line, continuous coiled tubing, threaded work string, etc. However, these tools need to be activated or set in place. The force needed to activate such a tool is large, for example, in excess of 15,000 lbs. In some instances, such a large force cannot be supplied by the conduit noted above.

A pyrotechnic setting tool is commonly used in the industry to activate the tools noted above. For example, a Baker style E-4 wireline pressure setting tool utilizes an externally mounted, manually operated, rupture type disc in order to release the internal high pressure gas once the setting tool is returned to the surface.

This setting tool 100 is shown in FIG. 1 and includes a firing head 102 that is connected to a pressure chamber 104. The firing head 102 ignites a primary igniter 103, which in turn ignites a power charge 106, which generates a high pressure gas 108. Note that a secondary igniter may be located between the primary igniter and the power charge to bolster the igniting effect of the primary igniter.

A cylinder 110 is attached, through a manual bleeder valve sub 105, having a connection 105A (e.g., threaded connection), to a housing 107 of the pressure chamber 104 and this cylinder fluidly communicates with the pressure chamber. Thus, when the power charge 106 burns, the high pressure gas 108 generated inside the pressure chamber 104 is guided into the cylinder 110. A floating piston 112, which is located inside the cylinder 110, is pushed by the pressure of the gas 108 to the right in the figure. Oil 115, stored in a first chamber 114 of the cylinder 110, is pushed through a connector sub 116 and a metering orifice 117, which are formed in a block 118 that is connected to the cylinder 110, to a second chamber 120, which is formed in a lower second cylinder 121. A second piston 122 is located in the lower second cylinder 121. Under the pressure exerted by the oil 115, the piston 122 and a piston rod 124 move downstream while exerting a large force on a crosslink 126, which transfers that force developed internally to moveable external crosslink sleeve 128. A setting sleeve 131 for the wellbore tool 150 to be set is attached to the lower end of the crosslink sleeve 128. The wellbore tool 150 is attached to the setting mandrel 133 by releasable means such as a partible stud, shear screws, etc.

Thus, when the setting tool is actuated, the setting sleeve 131 pushes components of the wellbore tool 150 to expand gripping members and a rubber packing while, at the same time, the setting mandrel 133 is holding the wellbore tool's interior body. When a predetermined force is reached, the releasing means fails, which frees the setting tool 100 for retrieval while the wellbore tool 150 is set. Note that cylinder 121 has the downstream end 130 sealed with a cylinder head 132 that allows the piston rod 124 to move downstream.

After the setting tool has been recovered to the surface, a large volume of pressurized gas 108 exists internally and must be bled away in order to clean and ready the setting tool for reuse. This high pressure gas 108 has comingled with the oil 115 used to stroke the wellbore tool, therefore rendering the oil too contaminated for reuse. Thus, this oil needs to be removed from the setting tool and be disposed of to prepare the setting tool for another use. To remove the high pressure gas and replace the contaminated oil, the entire setting tool must be disassembled and the parts cleaned and reassembled. This is not only time consuming, but also dangerous (bleeding the gas pressure off), especially at remote locations with improper faculties.

Relieving the high pressure gas 108 inside the pressure chamber 104 is not only dangerous to the health of the workers performing the task, because of the toxic gases left behind by the burning of the power charge, but is also a safety issue because the high pressure gas remaining inside the pressure chamber is high enough to injure the workers if its release procedure is not adhered to.

In this regard, note that the traditional setting tool 100 has a release valve 140 that is used for manually venting the high pressure gas from inside the pressure chamber. However, when the release valve 140 is improperly removed from the pressure chamber, the valve can become a flying projectile and injure the person removing it. For this reason, a dedicated removing procedure is put in place and also a safety sleeve is used to cover the release valve for relieving the pressure from the setting tool.

However, this procedure is cumbersome, time consuming and still, if a person misses any detail of the procedure, that person can get hurt by the release valve. Thus there is a need to create a safe method of automatically bleeding the high gas pressure from inside the setting tool while the setting tool is still inside the well bore. There is also a need to prevent comingling of the high pressure gas with the oil used to create the stroke motion of the setting tool. If these goals can be achieved, then once the setting tool is returned to the surface, all that would be required to do to return the setting tool to service is to wash out the ballistic power charge chamber, replace the expendables, and push the oil/piston back to their original position. Thus, there is a need for such an advanced setting tool.

SUMMARY

According to an embodiment, there is a setting tool for setting an auxiliary tool in a well. The setting tool includes a housing holding a floating piston assembly, an isolation valve assembly in fluid contact with an interior of the housing, and a frangible disc located to prevent a high-pressure gas to pass through a bore of the floating piston assembly.

According to another embodiment, there is a retrofitting kit for a setting tool for setting an auxiliary tool in a well. The retrofitting kit includes an isolation valve assembly to be located in a housing of the setting tool, and a floating piston assembly having a frangible disc. The frangible disc is located to prevent a pressured gas to move past the floating piston assembly into the housing.

According to still another embodiment, there is a method for shutting off a flow of oil and venting out a pressured gas from a setting tool. The method includes a step of lowering a setting tool into a well; a step of activating the setting tool so that a pressured gas is generated in the setting tool, and the pressured gas acts on a frangible disc that seals a bore of a floating piston assembly, where the disc prevents the pressured gas to move past the floating piston assembly; a step of translating an isolation valve assembly located in a housing of the setting tool to shut off a flow of oil; a step of opening a side port formed in the housing; and a step of breaking the frangible disc of the floating piston assembly to expel the pressured gas outside the housing, through the side port.

BRIEF DESCRIPTION OF THE DRAWINGS

The accompanying drawings, which are incorporated in and constitute a part of the specification, illustrate one or more embodiments and, together with the description, explain these embodiments. In the drawings.

DETAILED DESCRIPTION

The following description of the embodiments refers to the accompanying drawings. The same reference numbers in different drawings identify the same or similar elements. The following detailed description does not limit the invention. Instead, the scope of the invention is defined by the appended claims. The following embodiments are discussed, for simplicity, with regard to a setting tool. However, the embodiments discussed herein are also applicable to any tool in which a high-pressure gas is generated and then that high-pressure gas needs to be released outside the tool quickly and in efficient manner.

Reference throughout the specification to "one embodiment" or "an embodiment" means that a particular feature, structure or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics may be combined in any suitable manner in one or more embodiments.

According to an embodiment, an auto-bleeding setting tool has a floating piston assembly that separates the burnt gas (the gas that creates the residual unwanted pressure) from the oil that is used to set the wellbore device attached to the setting tool. The floating piston assembly incorporates a through bore that is temporally blocked by a frangible o-ring sealed disc that is held in place by a disc retainer. Placed inside the disc retainer is a rupture pin or bleed pin, which is held in a retarded position by two or more frangible shear screws. All elements of the floating piston assembly move as one when subjected to gas pressure produced by the burning pyrotechnic power charge. The floating piston assembly is placed inside a cylinder that is connected to the pressure chamber. The void space inside the cylinder, below the floating piston assembly, is filled with oil and the configuration of the floating piston assembly prevents the generated gas from comingling with the oil. The novel floating piston assembly can be retrofitted to an existing setting tool as now discussed.

Figure 1:
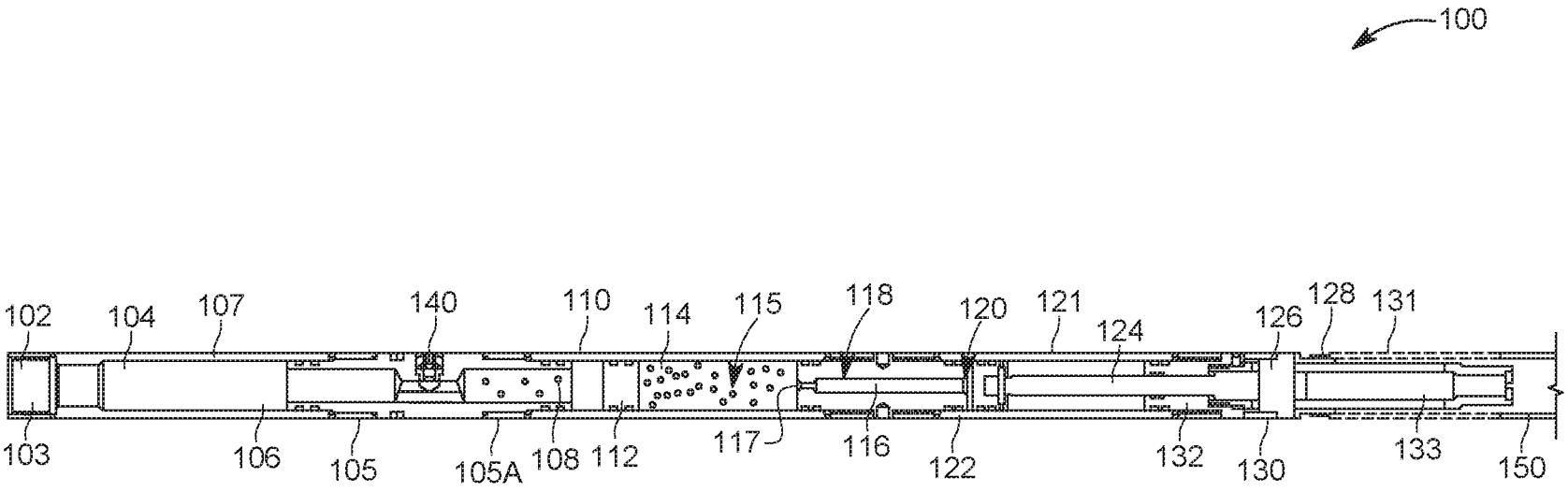
FIG. 1 illustrates a setting tool that needs to be retrieved to the surface for manually removing pressurized gas from inside.
Figure 2:
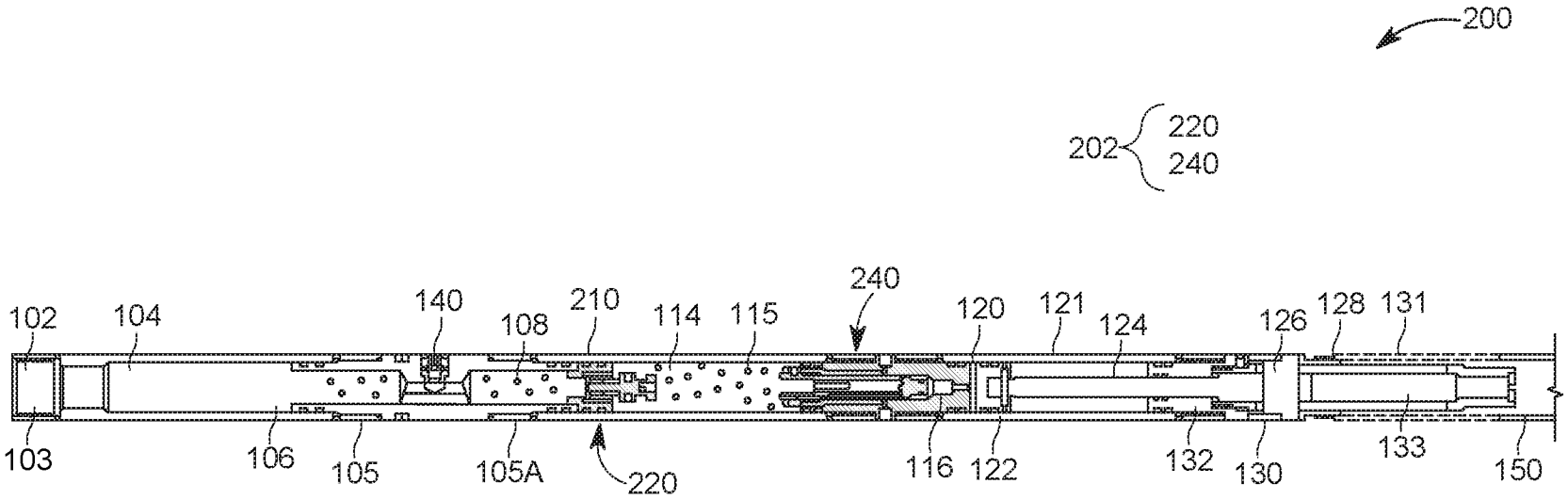
FIG. 2 illustrates an auto-bleeding setting tool that also automatically shuts off an oil flow.

FIG. 2 shows a setting tool 200 (for example, a Baker setting tool) that has been retrofitted with a retrofitting kit 202 that includes a floating piston assembly 220 and an isolation valve assembly 240. All the other elements of the setting tool 200 may be the ones shown in FIG. 1 and discussed above. Thus, their description is omitted herein. The floating piston assembly 220 is placed inside the upstream end of a housing 110. In this application, the term "upstream" is used to indicate a direction toward the head of the casing and the term "downstream" is used to indicate a direction toward the toe of the well. The void space 114 below the floating piston assembly 220 is filed with a measured column of oil 115 or a similar hydraulic fluid and for this reason the void space 114 will be described as hydraulic chamber 114. The floating piston assembly 220 and the isolation valve assembly 240 are now discussed in more detail with regard to FIGS. 3 and 4.

Figure 3:
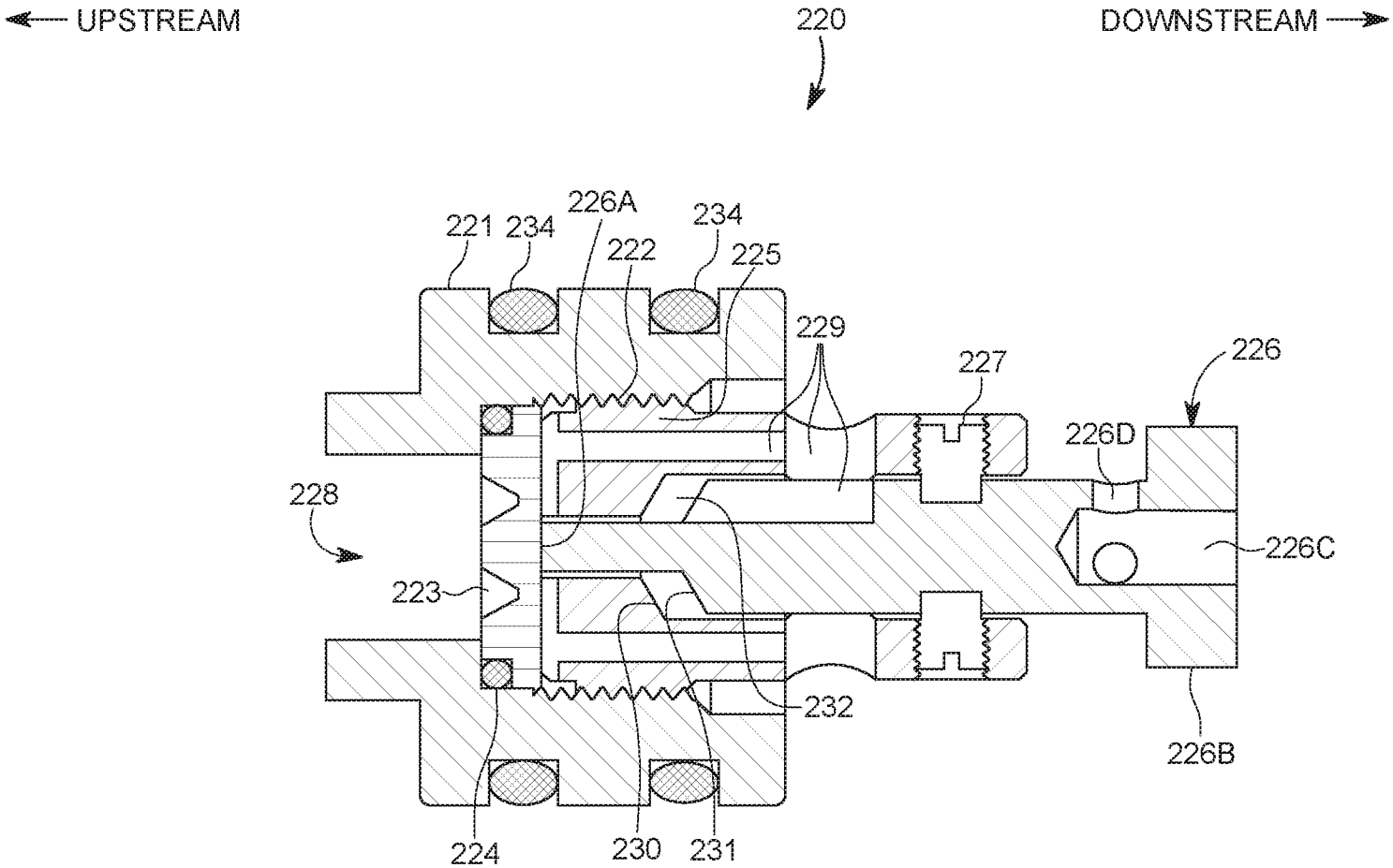
FIG. 3 illustrates a floating piston assembly that is part of the auto-bleeding setting tool.

FIG. 3 shows the floating piston assembly 220 having a piston body 221, a retainer nut 225 placed inside the body 221, and a bleed pin 226 partially located inside the piston body 221 and the retainer nut 225, and partially outside these elements. An outer portion of the retainer nut 225 is threaded, and it is configured to engage a mating thread 222 formed in the piston body 221. The piston body 221 has a passage 228 that extends throughout the body. A frangible disc (e.g., made of metal) 223 is placed to close and seal the passage 228, as illustrated in the figure. In one application, o-rings 224 may be located between the body 221 and disc 223 to prevent the high pressure gas and/or the oil to move past the disc. The retainer nut 225 holds the disc 223 in place inside the piston body 221. The bleed pin 226 has a first end 226A (or boss) that faces the disc 223. In one embodiment, there is a small gap between the first end 226A and the disc 223. However, in another application, the first end 226A is softly touching the disc 223.

The bleed pin 226 has a second end 226B, which is opposite to the first end 226A. The second end 226B has a partial bore 226C extending longitudinally along the bleed pin and starting on a downstream face, and also has a port 226D formed in a side of the bleed pin. Note that the partial bore 226C does not extend through the entire bleed pin. The partial bore 226C and the port 226D fluidly communicate with each other.

The bleed pin 226 is attached to the retainer nut 225 with two or more breakable pins 227. The bleed pin 226 has a shoulder 231 that mates with a corresponding shoulder 230 formed in the passage 228 of the piston body 221, when the bleed pin moves towards the retainer nut. However, in the initial configuration shown in FIG. 3, the two shoulders 230 and 231 are separated from each other, so that a passage 232 is formed between them. Further passages 229 are formed in the piston body 221 so that the high pressure gas from the hydraulic chamber can move through the floating piston assembly 220.

One or more o-rings 234 may be located on the outer part of the body 221 to seal an interface between the body and the housing 210, when the floating piston assembly 220 is placed inside the housing. Note that the floating piston assembly 220 of FIG. 3 is shown in FIG. 2 as being located at the upstream end of the housing 210. However, as will be discussed later, the floating piston assembly 220 will move downstream to engage the isolation valve assembly 240. Also note that the housing 210 may include not only a cylinder, as shown in the figures, but one or more subs or other connecting parts. Also, the floating piston assembly 220 and the isolation valve assembly 240 may be located in any of these parts of the housing.

Figure 4:
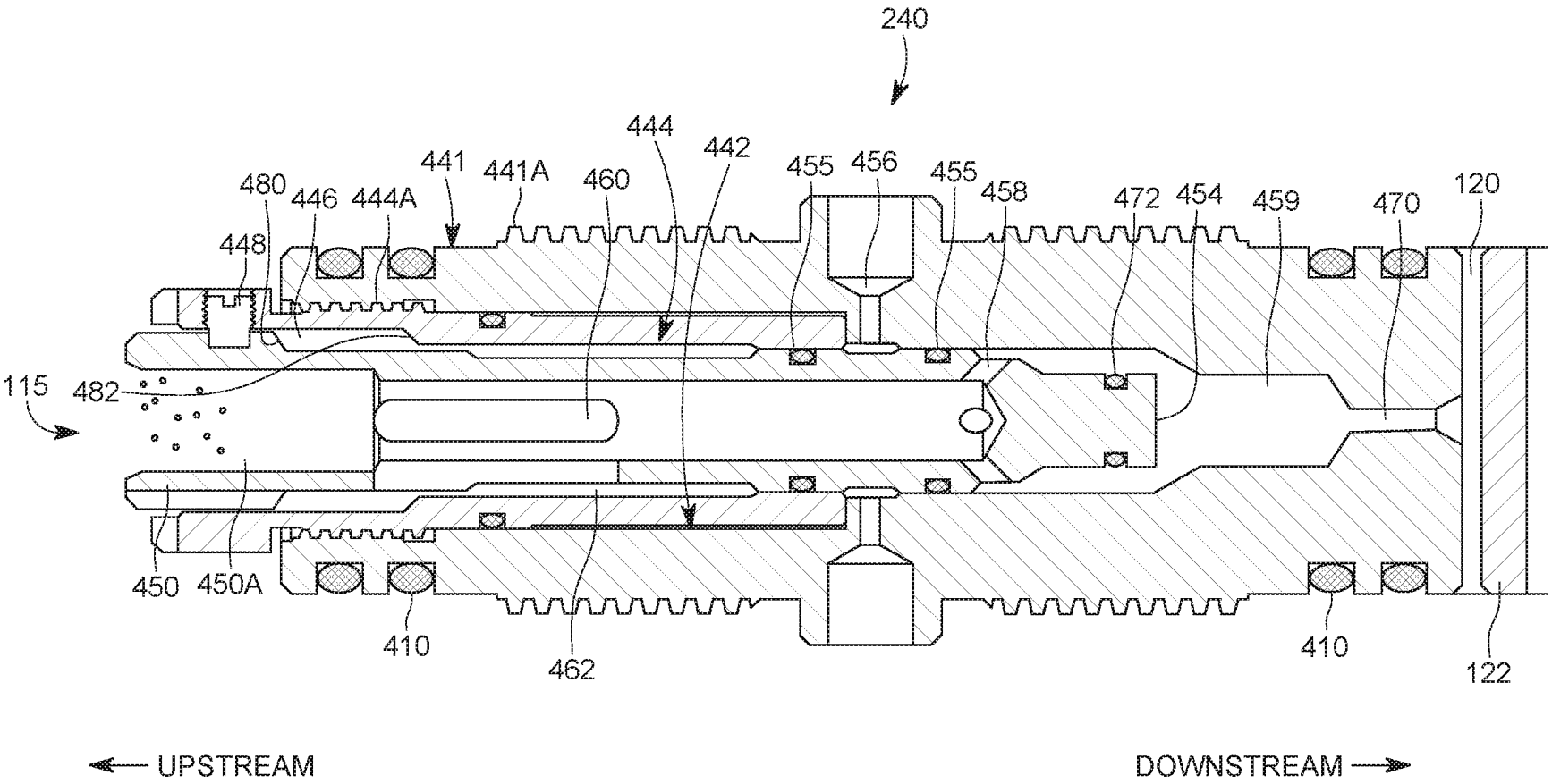
FIG. 4 illustrates an isolation valve assembly that is also part of the auto-bleeding setting tool.

The isolation valve assembly 240 is now discussed with regard to FIG. 4. The isolation valve assembly 240 connects to and seals the downstream end of the housing 210 shown in FIG. 2. The isolation valve assembly 240 includes a connector body 441, which is attached by threads 441A to the housing 210. The connection may be sealed with o-rings 410. The body 441 has an internal bore 442 that extends through the entire body 441. A sleeve insert 444 is provided inside the bore 442. The sleeve insert 444 is attached with threads 444A to the bore 442. Thus, the sleeve insert 444 cannot move relative to the body 441. In one embodiment, the body 441 is machined to replicate the sleeve 444 so that no additional sleeve is necessary. In this case, the body 441 and the sleeve 444 are formed as a single integral part.

Sleeve insert 444, in turn, has its own bore 446 into which a moveable isolation valve 450 is located. The moveable isolation valve 450 is attached in FIG. 4 to the sleeve insert 444 by one or more shear screw 448 (or any other breakable element) so that the sleeve insert 444 and the moveable isolation valve 450 do not initially move relative to each other, i.e., the moveable isolation valve 450's movement is restrained. Two o-rings 455 are placed between the moveable isolation valve 450 and the sleeve insert 444 and the body 441 to straddle perpendicular ports 456 formed in the body 441, i.e., to block a fluid to exit the isolation valve assembly 240 through the port 456. However, the moveable isolation valve 450 has passages 458 and slots 460 that allow the fluid inside the bore 450A, of the moveable isolation valve 450, to move past the moveable isolation valve 450, when the sleeve insert 444 is connected to the moveable isolation valve 450. Note that slots 460 in FIG. 4 fluidly communicate with passage 462. The passage 458 formed at the downstream end 454 of the moveable isolation valve 450 fluidly communicate with a sealing bore 459 and a metering orifice 470 formed in the body 441, at its downstream end. The sealing bore 459 and the metering orifice 470 are in fluid communication with the bore 442. The sealing bore 459 has one or more o-rings 472 for sealing the sealing bore 459 when the moveable isolation valve 450 is moved downstream, as discussed later. The isolation valve 450 has an outer shoulder 480 that mates with an inner shoulder 482 of the insert 444, so that a travel distance of the isolation valve 450 is limited, i.e., it is stopped when the two shoulders 480 and 482 are in contact with each other.

Oil 115 from the hydraulic chamber 104 (see FIG. 2) enters the bore 450A of the isolation valve 450 as shown in FIG. 4. When the isolation valve 450 is still attached to the sleeve insert 444, the oil 115 can move through bore 450A of the isolation valve 450, then through ports 458 to the sealing bore 459, metering orifice 470 and then to the second chamber 120, that holds the second piston 122 (which is also shown in FIG. 2) for actuating the wellbore tool 150. However, this path would be automatically closed when the isolation valve 450 moves downstream relative to the body 441, as discussed later.

Figure 5:
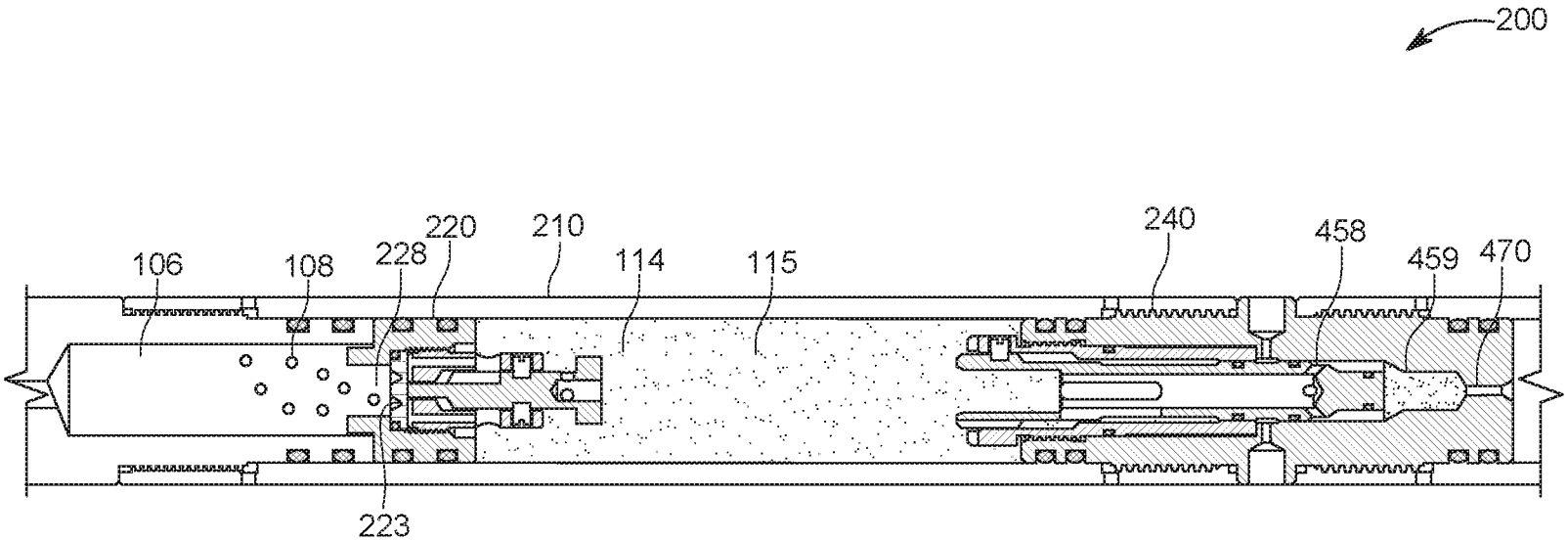
FIG. 5 illustrates the floating piston assembly and the isolation valve assembly placed inside a housing of the auto-bleeding setting tool.
Figure 6:
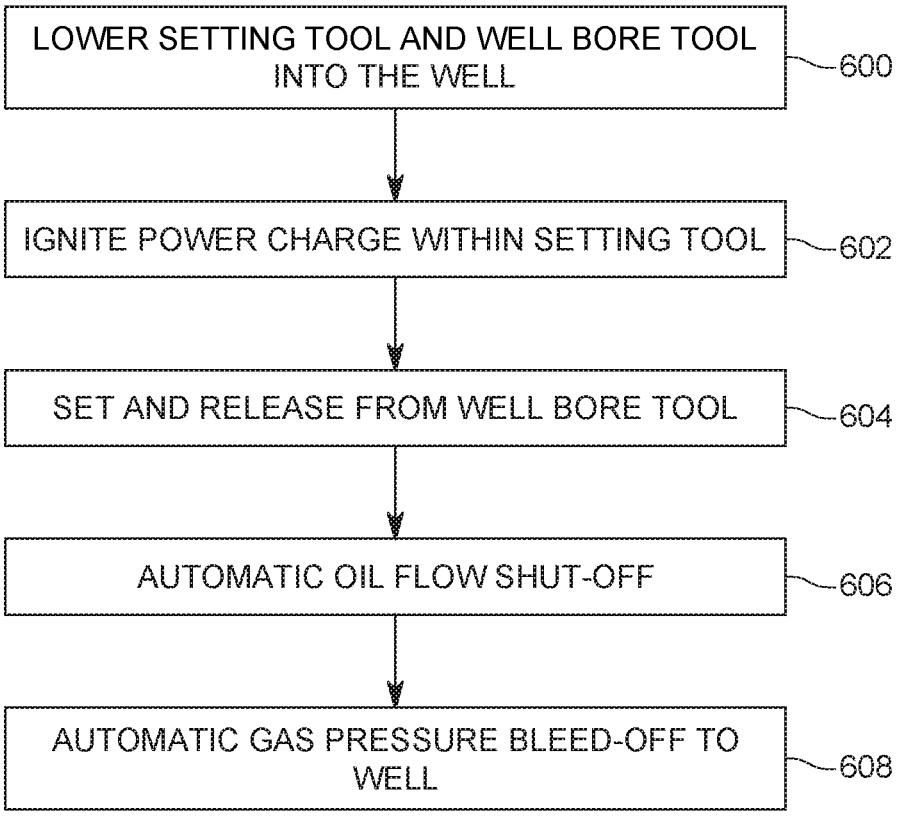
FIG. 6 is a flowchart of a method for activating the auto-bleeding setting tool.
Figure 7:
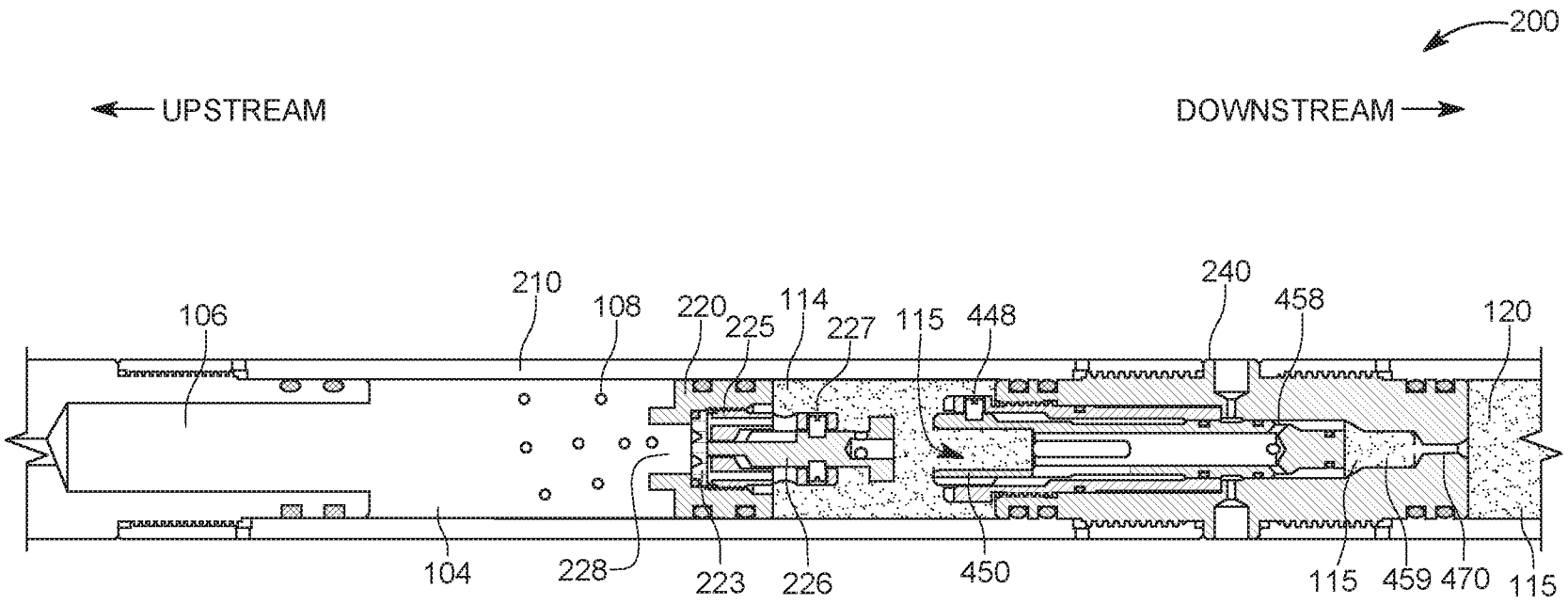
FIG. 7 illustrates the auto-bleeding setting tool when the floating piston assembly moves towards the isolation valve assembly.

FIG. 5 shows the setting tool 200 having the floating piston assembly 220 and the isolation valve assembly 240 both placed inside the housing 210, and ready to be actuated. A method for actuating this setting tool 200 is now discussed with regard to FIG. 6. In step 600, the setting tool 200 shown in FIG. 5 is attached to a wellbore tool 150 (see FIG. 2) and both elements are lowered into the well. The wellbore tool 150 may be a bridge plug or a packer. In step 602, the setting tool is actuated by, for example, igniting the primary igniter 103. The primary igniter 103 ignites the power charge 106 in the pressure chamber 104. The high pressure gas 108 enters the passage 228 and forces the floating piston assembly 220 to move downstream, as illustrated in FIG. 7. This happens because the disc 223 prevents the high pressure gas 108 to move past the floating piston assembly 220. As a result of this movement, the oil 115 in the hydraulic chamber 114 starts to be transferred downstream toward the second chamber 120, along the isolating valve assembly 240, though passages 458, sealing bore 459, and metering orifice 470. Note that FIG. 7 shows the floating piston assembly 220 being midway the setting tool stroke, and the hydraulic chamber 114 getting smaller. At this time the frangible disc 223 is still intact as the pressure applied to it is not enough to break it. For this reason, the floating piston assembly 220 is moving downstream and no high pressure gas 108 from the pressure chamber 104 comingles with the oil 115 in the hydraulic chamber 114.

However, at a location approximately mid-way of the setting tool stroke, the burning power charge 106 will have produced enough gas pressure to fully set and release, in step 604, from the wellbore tool 150. The setting tool 200 stroke travel will continue to its design limit and the automatic oil flow shut-off begin to occur in step 606.

As the floating piston assembly 220 continues to move downstream toward the isolation valve assembly 240, the disc bleed pin 226 contained inside the floating piston body 221, contacts and pushes against the upstream end of the isolation valve 250. As the force and movement is increased, the frangible shear screw 448 (see FIG. 4) connecting the sleeve insert 444 to the isolation valve 450 will shear (see parts 448A and 448B in FIG. 8), which allows the isolation valve 450 to be pushed downstream inside the sleeve insert 444. Note that the bleed pin 426 is held pinned inside the retainer nut 225 by two (or more) frangible shear screws 227 (see FIG. 7). This is to ensure that the isolation valve 450 moves downstream while the bleed pin 226 remains fixed in place inside the floating piston assembly 220 at this stage.

Figure 8:
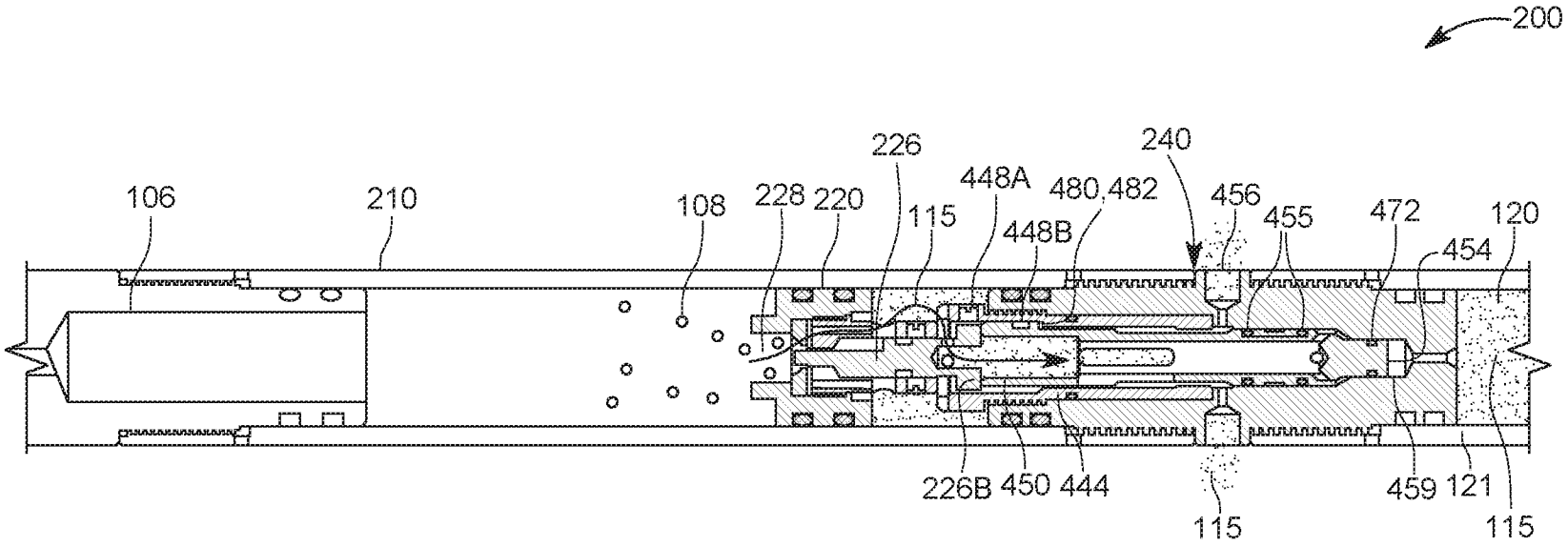
FIG. 8 illustrates the auto-bleeding setting tool when the floating piston assembly has engaged the isolation valve assembly.

As the isolation valve 450 is being pushed downstream inside the body 441 as illustrated in FIG. 8, the downstream end 454 and sealing o-ring 472 of the valve body 450 enter inside the sealing bore 459 and immediately and automatically stop the oil flow into the second chamber 120 of the lower second cylinder 121 as the most downstream part of the isolation valve 450 is machined to snugly fit inside the sealing bore 459. However, in one embodiment, it is possible to machine the most downstream part of the valve isolation body to have a smaller outer diameter than the sealing bore 459, so that oil 115 can still flow past the isolation valve 450 even if the internal gas pressure is being autobleed. At the same time, the two sealing o-rings 455 have moved downstream, uncovering the several perpendicular ports 456 located in the body 441. The remaining oil 115 being forced downstream by the floating piston assembly 220 is vented to the wellbore through the several perpendicular ports 456, i.e., outside the setting tool. Downstream movement of the isolation valve 450 ceases when the shoulder 480 of the valve contacts the shoulder 482 of the sleeve insert 444. This means that the oil located in the second chamber 120 and downstream has not been contaminated by the high pressure gas 108, while the small amount of oil that has been trapped above the second chamber 120 is being removed from the setting tool through the ports 456.

As the gas pressure in the pressure chamber 104 continues to exert a downstream push force on the floating piston assembly 220, the downstream end 226B of the bleed pin 226 is still pushing on the now immovable isolation valve 450 (see FIG. 8), so that enough force is created to shear the two (or more) frangible shear screws 227 linking the bleed pin 226 to the disc retainer 225 (see FIG. 3). Continued downstream movement of the floating piston body 221 allows the trapped frangible disc 223 to be penetrated by the boss 226A of the bleed pin 226 and the automatic bleed-off of the gas pressure begins in step 608. In other words, the high pressure gas 108 is now allowed to travel through the floating piston assembly 220 and then partially through the isolation valve assembly 240 and then to exit through the ports 456 outside the housing 410 of the setting tool 200. The floating piston assembly 220's movement downstream ceases when the disc 223 is penetrated and shoulders 230 and 231 (see FIG. 3) contact each other.

Figure 9:
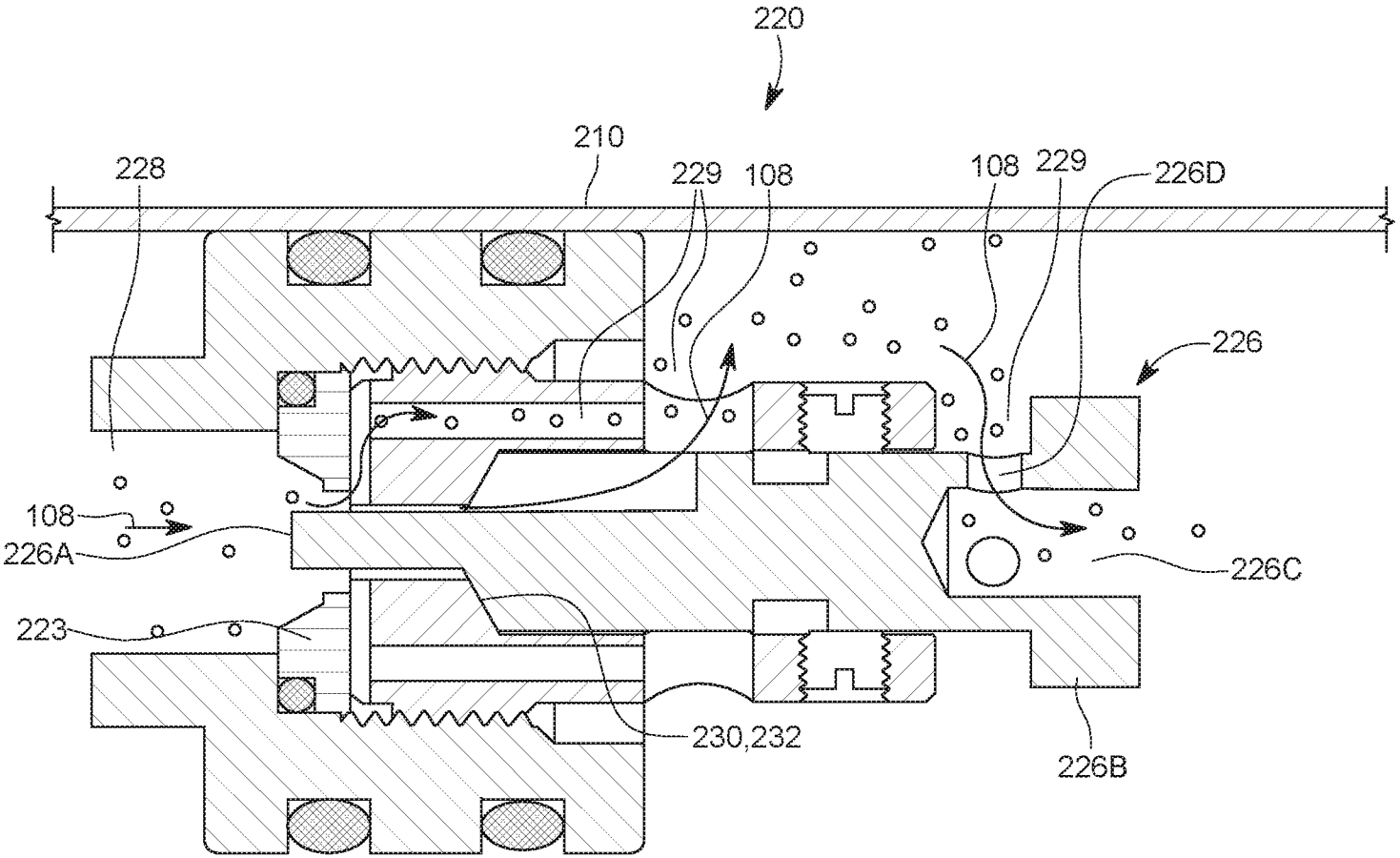
FIG. 9 illustrates the path of a pressured gas through the floating piston assembly.
Figure 10:
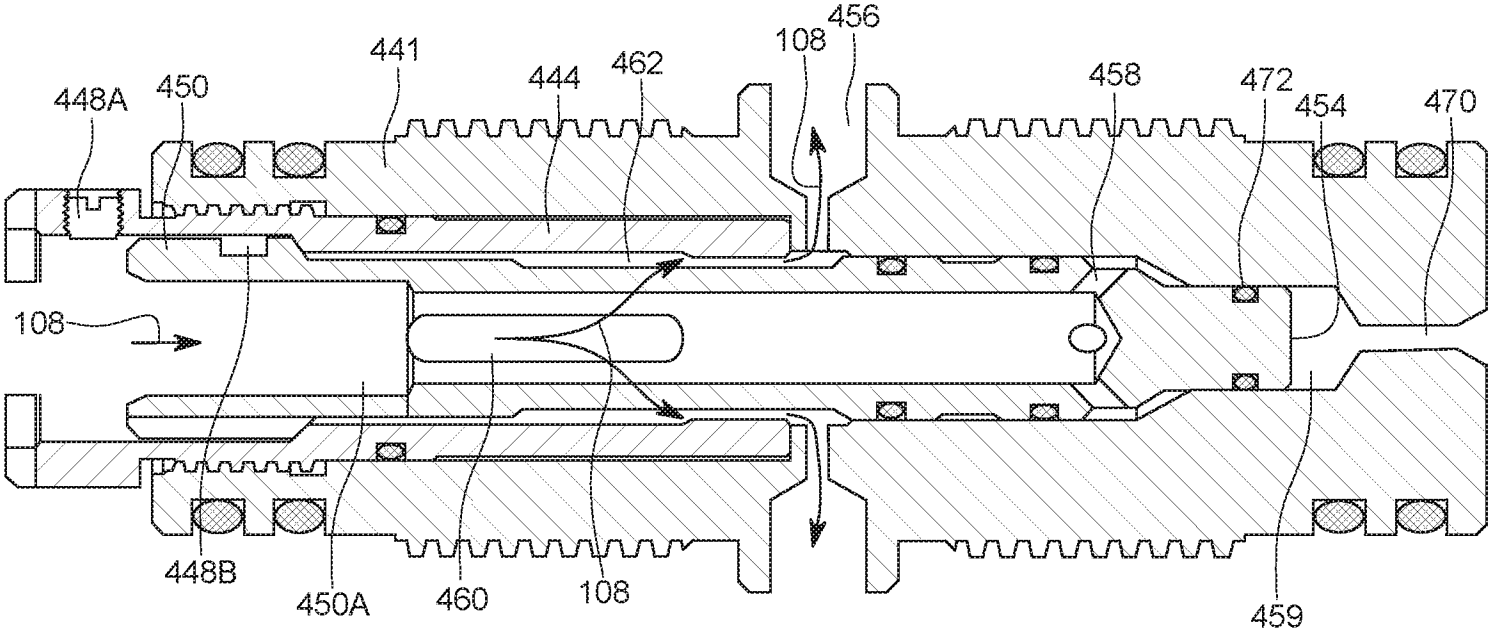
FIG. 10 illustrates the path of the pressured gas through the isolation valve assembly.

In this respect, FIG. 8 illustrates the final positions of the floating piston assembly 220 and the isolation valve assembly 240 when auto-bleeding has occurred. FIG. 9 illustrates the unblocked gas 108 flow through passage 228 and the passages 229. Note that the disc 223 is broken in FIG. 9 as the boss 226A of the bleed pin 226 has moved past the disc. FIG. 10 illustrates the unblocked gas 108 flow path through bore 450A, port 460, passage 462 inside the auto-bleeding setting tool 200 and out into the wellbore through port 456.

Figure 11:
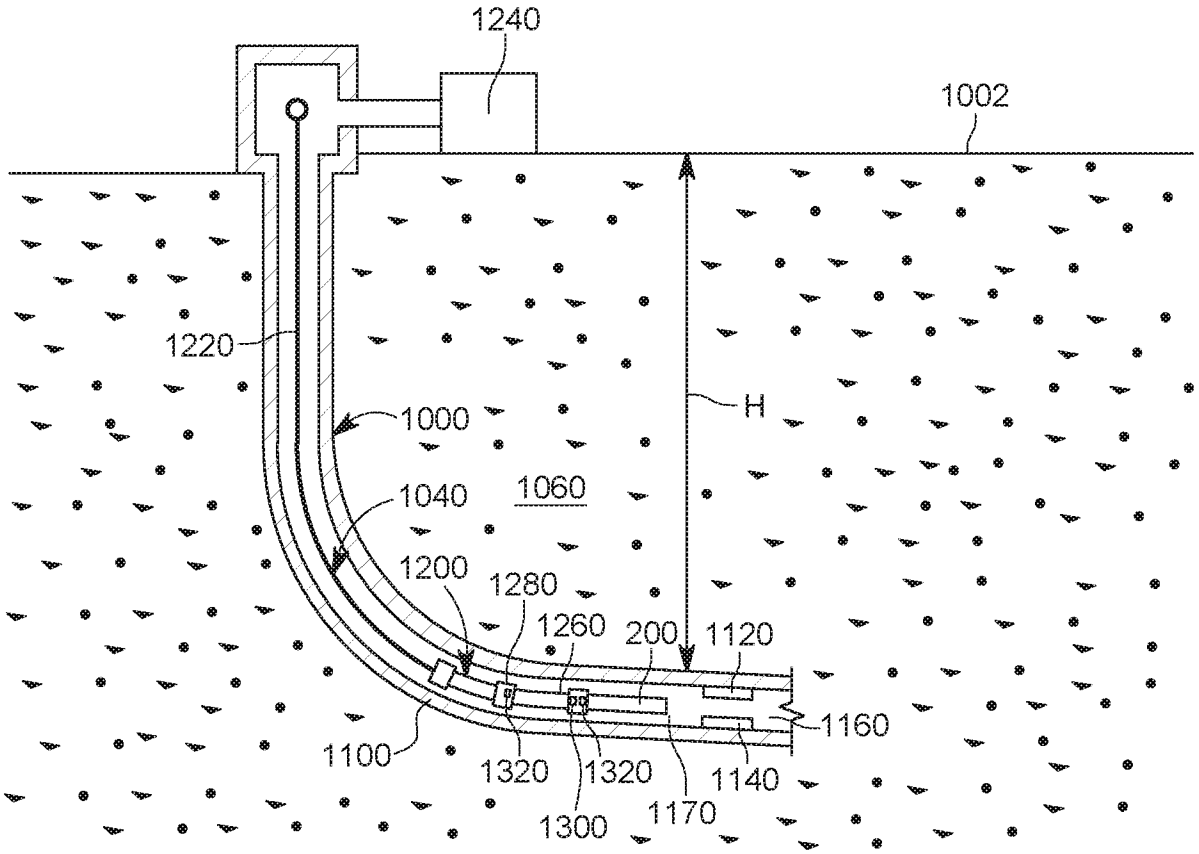
FIG. 11 illustrates the auto-bleeding setting tool when deployed in a well.

The setting tool 200 discussed in the previous embodiments may be used in a well as now discussed with regard to FIG. 11. FIG. 11 shows a well 1000 that was drilled to a desired depth H relative to the surface 1002. A casing string 1100 protecting the wellbore 1040 has been installed and cemented in place. To connect the wellbore 1040 to a subterranean formation 1060 to extract the oil and/or gas, various stages of the casing need to be perforated and then fractured. To perforate and then fracture a given stage, a wellbore tool 1120 (for example, a plug) needs to be set up in the well to insulate the downstream stages.

The typical process of connecting the casing to the subterranean formation may include the following steps: (1) connecting the plug 1120, which has a through port 1140 (known as a frac plug), to the setting tool 200, (2) lowering the setting tool 200 and the plug 1120 into the well, (3) setting up the plug by actuating the setting tool, and (4) perforating a new stage 1170 above the plug 1120. The step of perforating may be achieved with a gun string 1200 that is lowered into the well with a wireline 1220. A controller 1240 located at the surface controls the wireline 1220 and also sends various commands along the wireline to actuate one or more gun assemblies of the gun string or the setting tool 200, which is attached to the most distal gun assembly.

A traditional gun string 1200 includes plural carriers 1260 connected to each other by corresponding subs 1280, as illustrated in FIG. 11. Each sub 1280 includes a detonator 1300 and a corresponding switch 1320. The corresponding switch 1320 is actuated by the detonation of a downstream gun. When this happens, the detonator 1300 becomes connected to the through line, and when a command from the surface actuates the detonator 1300, the upstream gun is actuated. When the most distal detonator is actuated, the power charge 106 from the setting tool 200 is ignited and the setting tool is actuated, as discussed with regard to FIG. 6. The setting tool 200 is engaged to the auxiliary tool 1120 (e.g., a plug in this embodiment) when the detonator is actuated. After the setting tool has been activated, and the pressurized gas has set up the plug 1120, the pressurized gas from the setting tool is bled into the well, as discussed above with regard to the embodiments illustrated in FIGS. 2-10. After this or at the same time the setting tool 200 is retrieved from the plug 1120 as illustrated in FIG. 11, the operator of the gun string can start the fracturing process. Note that at this time, the oil in the setting tool has been insulated from the gas generated by the power charge, and the pressure accumulated in the pressure chamber has been vented out to the exterior of the setting tool. Thus, when the setting tool is brought to the surface, it is already vented and there is no gas under pressure that needs to be removed. Also to reset the setting tool it is much easier than before because the gas and oil did not comingle, and the oil 115 from the second chamber 120 can be reused as it has not been contaminated by the gas 108.

The setting tool discussed above may be manufactured to have the configuration illustrated in the previous figures. However, one skilled in the art would understand that the novel features shown in the above figures may also be implemented retroactively into the existing setting tools. Thus, in one embodiment, the floating piston of a traditional setting tool may be replaced with the floating piston assembly 220 shown in FIG. 3. Further, a traditional setting tool may be modified to receive the isolation valve assembly 240, which is shown in FIG. 4. Also note that the novel setting tool 200 shown in FIG. 2 may still include the release valve 140 provided at the pressure chamber 104, similar to the traditional setting tool 100 shown in FIG. 1. However, one skilled in the art would understand that the release valve 140 may be removed in the setting tool 200.

Figure 12:
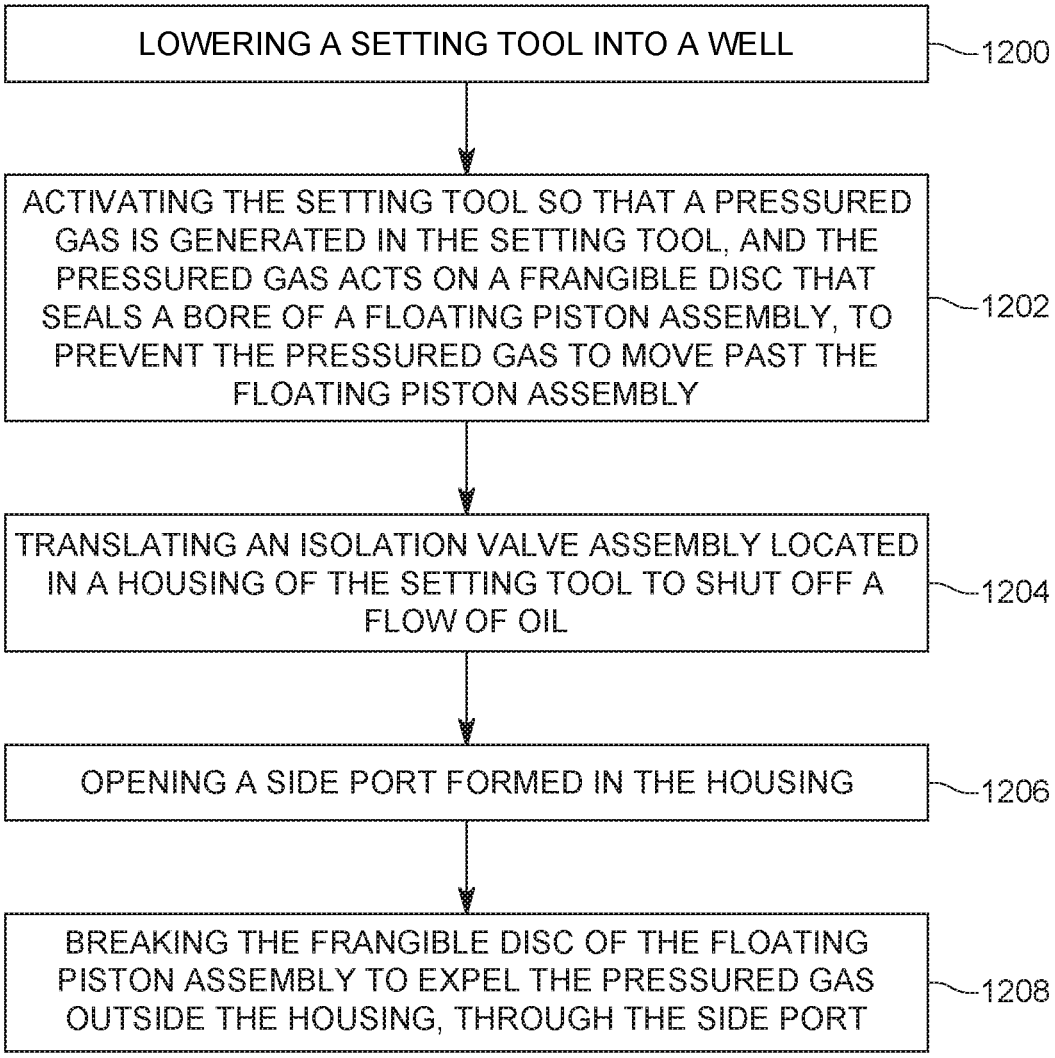
FIG. 12 is a flowchart of a method for actuating the auto-bleeding setting tool.

A method for shutting-off the oil flow and bleeding off the gas in a setting tool, as illustrated above, is now discussed with regard to FIG. 12. The method includes a step 1200 of lowering a setting tool 200 into a well, a step 1202 of activating the setting tool 200 so that a pressured gas 108 is generated in the setting tool 200, and the pressured gas 108 acts on a frangible disc 223 that seals a bore of a floating piston assembly 220, to prevent the pressured gas 108 to move past the floating piston assembly 220, a step 1204 of translating an isolation valve assembly 240 located in a housing 210 of the setting tool 200 to shut off a flow of oil, a step 1206 of opening a side port 456 formed in the housing 210, and a step 1208 of breaking the frangible disc of the floating piston assembly 220 to expel the pressured gas 108 outside the housing, through the side port 456.

The method may further include a step of translating the floating piston assembly along the housing under pressure from the pressured gas, to force a hydraulic liquid, which is stored between the floating piston assembly and the isolation valve assembly, to move past the isolation valve assembly, and/or a step of contacting the floating piston assembly with the isolation valve assembly, a step of pushing a moveable isolation valve of the floating piston assembly relative to a sleeve insert of the isolation valve assembly, to shut off the flow of the hydraulic liquid past the isolation valve assembly, and/or a step of further pushing the moveable isolation valve with the floating piston assembly so that a bleed pin of the floating piston assembly breaks from a connection with a body of the floating piston assembly and breaks the frangible disc to release the pressured gas outside the setting tool.

The disclosed embodiments provide methods and systems for automatically bleeding off a pressurized gas from a setting tool while located in a well and also shutting off a valve for preventing the pressurized gas to commingle with the oil used to actuated the setting tool. It should be understood that this description is not intended to limit the invention. On the contrary, the exemplary embodiments are intended to cover alternatives, modifications and equivalents, which are included in the spirit and scope of the invention as defined by the appended claims. Further, in the detailed description of the exemplary embodiments, numerous specific details are set forth in order to provide a comprehensive understanding of the claimed invention. However, one skilled in the art would understand that various embodiments may be practiced without such specific details.

Although the features and elements of the present exemplary embodiments are described in the embodiments in particular combinations, each feature or element can be used alone without the other features and elements of the embodiments or in various combinations with or without other features and elements disclosed herein.

This written description uses examples of the subject matter disclosed to enable any person skilled in the art to practice the same, including making and using any devices or systems and performing any incorporated methods. The patentable scope of the subject matter is defined by the claims, and may include other examples that occur to those skilled in the art. Such other examples are intended to be within the scope of the claims.

What is claimed is:

1. A setting tool for setting an auxiliary tool in a well, the setting tool comprising:

a housing holding a floating piston assembly, the floating piston assembly having a first end and a second end, which is opposite to the first end;

an isolation valve assembly in fluid communication with an interior of the housing, wherein the isolation valve assembly is facing the second end of the floating piston assembly; and a frangible disc located at the first end of the floating piston assembly, to prevent a high-pressure gas to pass through a bore of the floating piston assembly, wherein the floating piston assembly separates the frangible disc from the isolation valve assembly.

2. The setting tool of claim 1, wherein the floating piston assembly comprises:

a body having a bore; and a retainer nut attached to the bore and configured to hold the frangible disc in place.

3. The setting tool of claim 2, further comprising:

a bleed pin placed in a bore of the retainer nut; and a shear pin that maintains the retainer nut attached to the bleed pin.

4. The setting tool of claim 1, wherein the isolation valve assembly comprises:

a body having a bore;

a sleeve insert located inside the bore, the sleeve insert having a bore; and a moveable isolation valve located inside the bore of the sleeve insert, wherein a first end of the moveable isolation valve is in contact with the sleeve insert and a second end of the moveable isolation valve, is not in contact with the body.

5. The setting tool of claim 4, wherein the sleeve insert is fixedly attached to the body with threads, and the moveable isolation valve is movably attached to the sleeve insert with a shear screw.

6. The setting tool of claim 5, wherein the body has a side port that allows fluid communication between an inner part of the isolation valve assembly and an outer part of the isolation valve assembly.

7. The setting tool of claim 6, wherein the moveable isolation valve has a bore that does not fluidly communicate with the side port when the second end of the moveable isolation valve is not in contact with the body.

8. The setting tool of claim 6, wherein the moveable isolation valve has a bore that does fluidly communicate with the side port when the second end of the moveable isolation valve is in contact with the body.

9. The setting tool of claim 4, wherein the sleeve insert and the body are formed as an integral piece.

10. The setting tool of claim 1, further comprising:

a hydraulic chamber located within the housing, between the floating piston assembly and the isolation valve assembly, wherein the hydraulic chamber is filled with a hydraulic liquid.

11. The setting tool of claim 10, wherein the floating piston assembly is configured to slide within the housing under pressure from the pressured gas, and to force the hydraulic liquid to move from the hydraulic chamber past the isolation valve assembly.

12. The setting tool of claim 11, wherein the floating piston assembly is configured to contact the isolation valve assembly and to push a moveable isolation valve relative to a sleeve insert of the isolation valve assembly to shut off a flow of the hydraulic liquid past the isolation valve assembly.

13. The setting tool of claim 12, wherein the floating piston assembly is configured to further push the moveable isolation valve relative to the body so that a bleed pin of the floating piston assembly breaks from a connection with a body of the floating piston assembly and breaks the frangible disc to release the pressured gas into the isolation valve assembly and outside the setting tool.

14. The setting tool of claim 13, wherein the frangible disc is located in a bore of a body of the floating piston assembly, facing the bleed pin.

15. The setting tool of claim 1, further comprising:

a release valve connected to the housing and configured to fluidly communicate the inside of the setting tool with the outside when the release valve is manually opened.

16. A retrofitting kit for a setting tool for setting an auxiliary tool in a well, the retrofitting kit comprising:

an isolation valve assembly to be located in a housing of the setting tool; and a floating piston assembly having a frangible disc, wherein the frangible disc is located at a first end of the floating piston to prevent a pressured gas to move past the floating piston assembly into the housing, and the isolation valve assembly is configured to engage a second end of the floating piston assembly, and wherein the floating piston assembly separates the frangible disc from the isolation valve assembly.

17. The retrofitting kit of claim 16, wherein the floating piston assembly comprises:

a body having a bore; and a retainer nut attached to the bore and configured to hold the frangible disc in place.

18. The retrofitting kit of claim 17, further comprising:

a bleed pin placed in a bore of the retainer nut; and a shear pin that maintains the retainer nut attached to the bleed pin.

19. The retrofitting kit of claim 18, wherein the isolation valve assembly comprises:

a body having a bore;

a sleeve insert located inside the bore, the sleeve insert having a bore; and a moveable isolation valve located inside the bore of the sleeve insert, wherein a first end of the moveable isolation valve is in contact with the sleeve insert and a second end of the moveable isolation valve is not in contact with the body.

20. The retrofitting kit of claim 19, wherein the sleeve insert is fixedly attached to the body with threads, and the moveable isolation valve is movably attached to the sleeve insert with a shear screw.

21. The retrofitting kit of claim 20, wherein the body has a side port that allows fluid communication between an inside of the isolation valve assembly and an outside of the isolation valve assembly.

22. The retrofitting kit of claim 21, wherein the moveable isolation valve has a bore that does not fluidly communicate with the side port when the second end of the moveable isolation valve is not in contact with the body.

23. The retrofitting kit of claim 21, wherein the moveable isolation valve has a bore that does fluidly communicate with the side port when the second end of the moveable isolation valve is in contact with the body.

24. The retrofitting kit of claim 19, wherein the sleeve insert and the body are formed as an integral piece.

25. The retrofitting kit of claim 16, wherein the floating piston assembly is configured to slide within the housing when under pressure from the pressured gas, and to force the hydraulic liquid to move from the hydraulic chamber past the isolation valve assembly.

26. The retrofitting kit of claim 25, wherein the floating piston assembly is configured to contact the isolation valve assembly and to push a moveable isolation valve relative to a sleeve insert of the isolation valve assembly to shut off a flow of the hydraulic liquid past the isolation valve assembly.

27. The retrofitting kit of claim 26, wherein the floating piston assembly is configured to further push the moveable isolation valve relative to the body so that a bleed pin of the floating piston assembly breaks from a connection with a body of the floating piston assembly and breaks the frangible disc to release the pressured gas outside the setting tool.

28. The retrofitting kit of claim 27, wherein the frangible disc is located in a bore of the body of the floating piston assembly, facing the bleed pin.

29. A method for shutting off a flow of oil and venting out a pressured gas from a setting tool, the method comprising:

lowering a setting tool into a well;

activating the setting tool so that a pressured gas is generated in the setting tool, and the pressured gas acts on a frangible disc that seals a bore of a floating piston assembly, wherein the disc prevents the pressured gas to move past the floating piston assembly;

translating an isolation valve assembly located in a housing of the setting tool to shut off a flow of oil;

opening a side port formed in the housing; and breaking the frangible disc of the floating piston assembly to expel the pressured gas outside the housing, through the side port.

30. The method of claim 29, further comprising:

translating the floating piston assembly, along the housing, under pressure from the pressured gas, to force a hydraulic liquid, which is stored between the floating piston assembly and the isolation valve assembly, to move past the isolation valve assembly.

31. The method of claim 30, further comprising:

contacting the floating piston assembly with the isolation valve assembly; and pushing a moveable isolation valve of the floating piston assembly relative to a sleeve insert of the isolation valve assembly, to shut off the flow of the hydraulic liquid past the isolation valve assembly.

32. The method of claim 31, further comprising:

further pushing the moveable isolation valve with the floating piston assembly so that a bleed pin of the floating piston assembly breaks from a connection with a body of the floating piston assembly and breaks the frangible disc to release the pressured gas outside the setting tool.

* * * * *